US011587477B2

(12) United States Patent
Sullivan et al.

(10) Patent No.: US 11,587,477 B2
(45) Date of Patent: Feb. 21, 2023

(54) ARTICLE RETAINMENT APPARATUS HAVING A FLUID SEAL AND SYSTEM COMPRISING SAID APPARATUS

(71) Applicants: Geri-Lynn Spellman Sullivan, Flanders, NJ (US); Karen Spellman Zachacz, Stanley, KS (US); Daniel Patrick Sullivan, Flanders, NJ (US)

(72) Inventors: Geri-Lynn Spellman Sullivan, Flanders, NJ (US); Karen Spellman Zachacz, Stanley, KS (US); Daniel Patrick Sullivan, Flanders, NJ (US)

( * ) Notice: Subject to any disclaimer, the term of this patent is extended or adjusted under 35 U.S.C. 154(b) by 836 days.

(21) Appl. No.: 15/420,593

(22) Filed: Jan. 31, 2017

(65) Prior Publication Data

US 2017/0236461 A1 Aug. 17, 2017

Related U.S. Application Data

(60) Provisional application No. 62/293,859, filed on Feb. 11, 2016.

(51) Int. Cl.

| | |
|---|---|
| ***G09F 3/02*** | (2006.01) |
| ***A47G 1/12*** | (2006.01) |
| ***G09F 19/02*** | (2006.01) |
| ***G09F 23/00*** | (2006.01) |

(52) U.S. Cl.

CPC ..... *G09F 19/02* (2013.01); *G09F 23/00* (2013.01)

(58) Field of Classification Search

None

See application file for complete search history.

(56) References Cited

U.S. PATENT DOCUMENTS

| | | | |
|---|---|---|---|
| 3,009,594 | A | 11/1961 | Anson |
| 3,439,826 | A | 4/1969 | Michelino |
| 3,440,128 | A | 4/1969 | Kubilius |
| 4,173,667 | A | 11/1979 | Rusch |
| D255,548 | S | 6/1980 | Grodin |
| 4,224,364 | A | 9/1980 | Hunt |

(Continued)

FOREIGN PATENT DOCUMENTS

| | | |
|---|---|---|
| CN | 201299747 | 9/2009 |
| CN | 203806285 | 9/2014 |

(Continued)

OTHER PUBLICATIONS

Do, Suh Ah, machine translation of KR 200192304, Aug. 16, 2000 (Year: 2000).*

(Continued)

*Primary Examiner* — Mary I Omori

(74) *Attorney, Agent, or Firm* — Gearhart Law LLC

(57) ABSTRACT

A retainment device may have a retainment vessel with a first section and a second section that, when joined, form a hollow retainment device. The retainment device may provide a fluid seal allowing both liquid and/or solid objects to be retained within the interior. The retainment device is preferably transparent and enables one to attach it to various items such as a bottle stopper or a keychain. Items may be stored within the retainment vessel and viewed therethrough. A tag mechanism may allow a description of the object contained within the retainment mechanism to be identified.

15 Claims, 7 Drawing Sheets

(56) References Cited

U.S. PATENT DOCUMENTS

| | | | | |
|---|---|---|---|---|
| 4,248,071 | A * | 2/1981 | Kussoy | A44B 15/002 70/456 R |
| 4,446,673 | A | 5/1984 | Desthieux | |
| 4,665,668 | A | 5/1987 | Serpico | |
| D338,317 | S | 8/1993 | Woodward | |
| D338,329 | S | 8/1993 | Cornwall | |
| 5,479,796 | A * | 1/1996 | Shimano | A44B 15/005 63/18 |
| 5,672,089 | A | 9/1997 | Piera Bermejo | |
| D384,824 | S | 10/1997 | Johnson | |
| D386,112 | S | 11/1997 | Wolf | |
| 5,713,147 | A | 2/1998 | Johnson | |
| 5,811,159 | A * | 9/1998 | Chang | A44B 15/005 428/11 |
| D427,907 | S | 7/2000 | Isbell | |
| 6,135,323 | A * | 10/2000 | Chen | B05B 11/0005 222/135 |
| 6,165,041 | A * | 12/2000 | Lin | A63H 23/08 40/409 |
| 6,176,705 | B1 * | 1/2001 | Garvey | A63H 3/00 434/284 |
| 6,438,878 | B1 * | 8/2002 | Fine | G09F 19/02 40/406 |
| 6,562,423 | B2 | 5/2003 | Rubin | |
| D475,288 | S | 6/2003 | Hoffmann et al. | |
| D475,293 | S | 6/2003 | Abrams | |
| D492,403 | S | 6/2004 | Iddan et al. | |
| 7,004,441 | B1 * | 2/2006 | Rutland | G09F 23/00 248/690 |
| D536,968 | S | 2/2007 | Keller | |
| D564,900 | S | 3/2008 | Green et al. | |
| 7,373,702 | B1 | 5/2008 | Vonderheide | |
| D575,639 | S | 8/2008 | Seeuwen et al. | |
| 7,546,753 | B1 * | 6/2009 | Kim | A44B 15/005 206/37.1 |
| D677,566 | S | 3/2013 | Dubow | |
| 2004/0123500 | A1 * | 7/2004 | Lau | A44B 15/005 40/124.01 |
| 2005/0005409 | A1 | 1/2005 | Elnatan | |
| 2005/0167288 | A1 * | 8/2005 | Sottile | A44B 15/005 206/38.1 |
| 2009/0122524 | A1 * | 5/2009 | Yang | B65D 51/245 362/101 |
| 2009/0294452 | A1 | 12/2009 | Melrose et al. | |
| 2010/0122709 | A1 * | 5/2010 | Janatpour | A45F 5/00 132/286 |
| 2011/0003655 | A1 * | 1/2011 | Chernick | A63B 39/00 473/594 |
| 2011/0253731 | A1 * | 10/2011 | Smith | B65D 25/22 220/751 |
| 2014/0358804 | A1 | 12/2014 | Stransky | |
| 2015/0013383 | A1 * | 1/2015 | Weems | A44C 25/002 63/18 |
| 2016/0120337 | A1 * | 5/2016 | Cruz | A47F 3/145 206/457 |

FOREIGN PATENT DOCUMENTS

| | | | | |
|---|---|---|---|---|
| CN | 203806358 | | 9/2014 | |
| EP | 2310288 | B1 * | 2/2012 | B65D 51/20 |
| GB | 9817613 | | 10/1998 | |
| GB | 2498939 | A * | 8/2013 | A47G 33/08 |
| JP | 06185076 | | 7/1994 | |
| JP | 2006180911 | A * | 7/2006 | |
| JP | 2009285419 | | 12/2009 | |
| JP | 2012062456 | | 3/2012 | |
| JP | 3188077 | | 12/2013 | |
| KR | 2019940012503 | | 6/1994 | |
| KR | 200174386 | | 12/1999 | |
| KR | 200192304 | | 6/2000 | |
| KR | 100419144 | | 2/2004 | |
| KR | 1020100121860 | | 11/2010 | |
| KR | 2020110003593 | | 4/2011 | |
| WO | 9422736 | | 10/1994 | |
| WO | 2013049874 | | 4/2013 | |

OTHER PUBLICATIONS

Nor-Cal Products, What Are The Advantages & Disadvantages of Metal Seals and Elastomer (O-Ring) Seals, Oct. 23, 2014 (Year: 2014).*

Yamaguchi et al., machine translation of JP 2006-180911, Jul. 13, 2006 (Year: 2006).*

"Wine Stopper Kit with Circle Bezel", <https://www.goodybeads.com/store/products/A013512.htm> (Accessed May 2, 2017).

* cited by examiner

ARTICLE RETAINMENT APPARATUS HAVING A FLUID SEAL AND SYSTEM COMPRISING SAID APPARATUS

CLAIM OF PRIORITY

This application claims priority to U.S. Application 62/293,859 filed on Feb. 11, 2016, the contents of which are hereby fully incorporated by reference in its entirety.

FIELD OF THE EMBODIMENTS

The field of the embodiments of the present invention relate to retainment devices, namely retainment devices which allows any number of individuals to store and/or view the contents contained therein. In particular, the field relates to items intended to hold keepsakes bought, collected, or otherwise obtained and display said keepsakes for viewing and remembrance.

BACKGROUND OF THE EMBODIMENTS

Keepsakes or mementos are kept by people all over the globe as ways to remember people, places, events, etc. that have a particular meaning or sentimentality attached to it. For example, an individual may purchase a seashell from a beach side store which serves as a reminder to a vacation they took with their family. In other instances, an individual may have received an item from a close friend or family member and that item helps them to conjure particular thoughts or memories associated with that friend or family member. These items may come in all shapes, colors, and sizes and may virtually be any item to which meaning can be prescribed.

Often times, such items may be fragile or small which can cause them to easily become lost or broken. Such an event may be devastating to the owner of the item as the item may be irreplaceable and have great meaning for that person. Further, it is often customary to display or show various keepsakes, mementos, etc. for purposes of discussion and remembrance with friends and family. Thus, there is a need for an apparatus capable of displaying and/or describing such an item and further keeping it safe while it is displayed. The present invention and its embodiments meets and exceeds these objectives.

Review of Related Technology

U.S. Pat. No. 5,713,147 pertains to a transparent globular photograph holder. The holder consists of a pair of transparent semiglobular members—each such complementary transparent member consisting of a hollow semiglobe having a flat, planar, circular face, said flat, planar, circular face constituting an inner frame disc. Each such inner frame disc consists of an integrally-formed inner circular ring for co-operating together to provide back-up rings for holding two photographs, back-to-back, for two-way viewing. The hollow semiglobes are being selectively secured together at a selected area of their respective flat, planar, circular faces by hinge means. They also are releasably temporarily locked together at another area of their respective flat, planar, circular faces by means of a flexible clasp on one of said inner frame discs which co-operates with a retaining slot in said other inner frame disc: means are provided for hanging the transparent globular photograph holder.

U.S. Patent Application 2011/0253731 pertains to an annular attachment device that is adapted to engage the threads of a threaded container and provide a connection point for the threaded container. In such an arrangement, the threads of a container may be placed through a center aperture in the attachment device. By threading a lid onto the container, the annular attachment device may be trapped between the container and its lid. An aperture or hook on an outer surface of the annular attachment device allows the device and a supported container to be tethered to a desired location.

Various systems and methodologies are known in the art. However, their structure and means of operation are substantially different from the present disclosure. The other inventions fail to solve all the problems taught by the present disclosure. The present invention and its embodiments provide for a lightweight, fluid sealed, portable apparatus that holds an item for viewing and safe keeping. The present invention may further be coupled to items, such as a bottle stopper or a keychain, to be displayed and serve as a functional gripping surface. At least one embodiment of this invention is presented in the drawings below and will be described in more detail herein.

SUMMARY OF THE EMBODIMENTS

In general the present invention and its embodiments provide for a keepsake apparatus intended to provide a hollow object with a transparent or translucent or opaque surface. Items may be stored within the apparatus for viewing and enjoyment by the owner of the item and those associated with said owner. The apparatus may have a fluid seal allowing it to contain either solid or liquid items or a combination thereof. In some embodiments, an internal divider may be used to separate the interior into multiple compartments. The present invention and its embodiments may then be coupled to another item, such as a bottle stopper or a keychain, so that is may serve as a functional surface or display piece on such a secondary object.

In one embodiment of the present invention there is a keepsake apparatus having a retainment vessel comprising a first section having first threads and a second section having second threads, the first section being capable of being threadably engaged to the second section, wherein the first threads and the second threads form a fluid seal; a protruding member extending from the retainment vessel, wherein the protruding member is capable of being coupled to a secondary object.

In another embodiment of the present invention there is a keepsake apparatus having a transparent, substantially circular retainment vessel comprising a first section having first threads and a second section having second threads, the first section being capable of being threadably engaged to the second section, wherein the first threads and the second threads form a fluid seal, and wherein the first section and the second section have a thickness defining an interior space of the retainment vessel when the first section is coupled to the second section; a threaded protruding member extending from a top end of the retainment vessel, wherein the threaded protruding member is capable of being coupled to a threaded receptacle on a keychain or a bottle stopper; at least one planar surface disposed on a bottom surface of the retainment vessel; and an annular sealing member disposed on an outer surface of the retainment vessel, the annular sealing member covering a juncture of the first section and the second section.

In another embodiment of the present invention there is a keepsake system having a transparent, substantially circular retainment vessel comprising, a first section having first threads and a second section having second threads, the first section being capable of being threadably engaged to the second section, wherein the first threads and the second threads form a fluid seal, and wherein the first section and the second section have a thickness defining an interior space of the retainment vessel when the first section is coupled to the second section; a threaded protruding member extending from a top end of the retainment vessel, wherein the threaded protruding member is capable of being coupled to a threaded receptacle on a keychain or a bottle stopper; at least one planar surface disposed on a bottom surface of the retainment vessel; and a tag member capable of being coupled to the retainment vessel, the tag member having at least one writable surface thereon.

In general, the present invention succeeds in conferring the following, and others not mentioned, benefits and objectives.

It is an object of the present invention to provide a keepsake apparatus that is lightweight and portable.

It is an object of the present invention to provide a keepsake apparatus that is capable of retaining item(s) placed therein and present the item(s) for viewing.

It is an object of the present invention to provide a keepsake apparatus that may be used by individuals of all ages.

It is an object of the present invention to provide a keepsake apparatus that identifies information pertaining to the keepsake(s) contained therein.

It is an object of the present invention to provide a keepsake apparatus that is reusable. It is an object of the present invention to provide a keepsake apparatus that has a fluid seal enabling liquids and/or solids to be retained therein.

It is an object of the present invention to provide a keepsake apparatus that may be coupled to another item such as a keychain, bottle stopper, or the like.

It is an object of the present invention to provide a keepsake apparatus that is durable and resilient.

DESCRIPTION OF THE PREFERRED EMBODIMENTS

Figure 1:
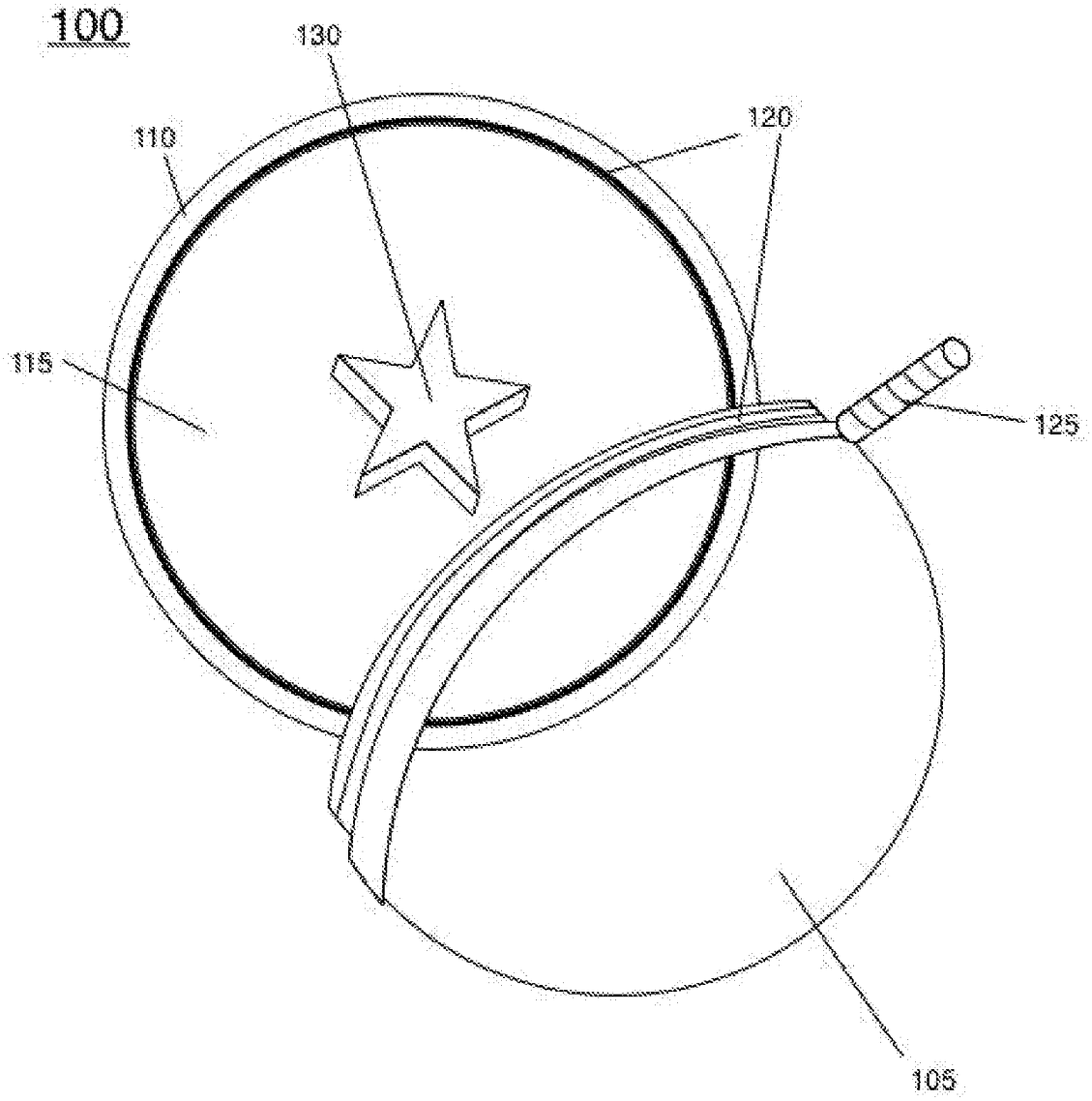
FIG. 1 is a perspective view of an embodiment of the present invention in a disassembled form.
Figure 2:
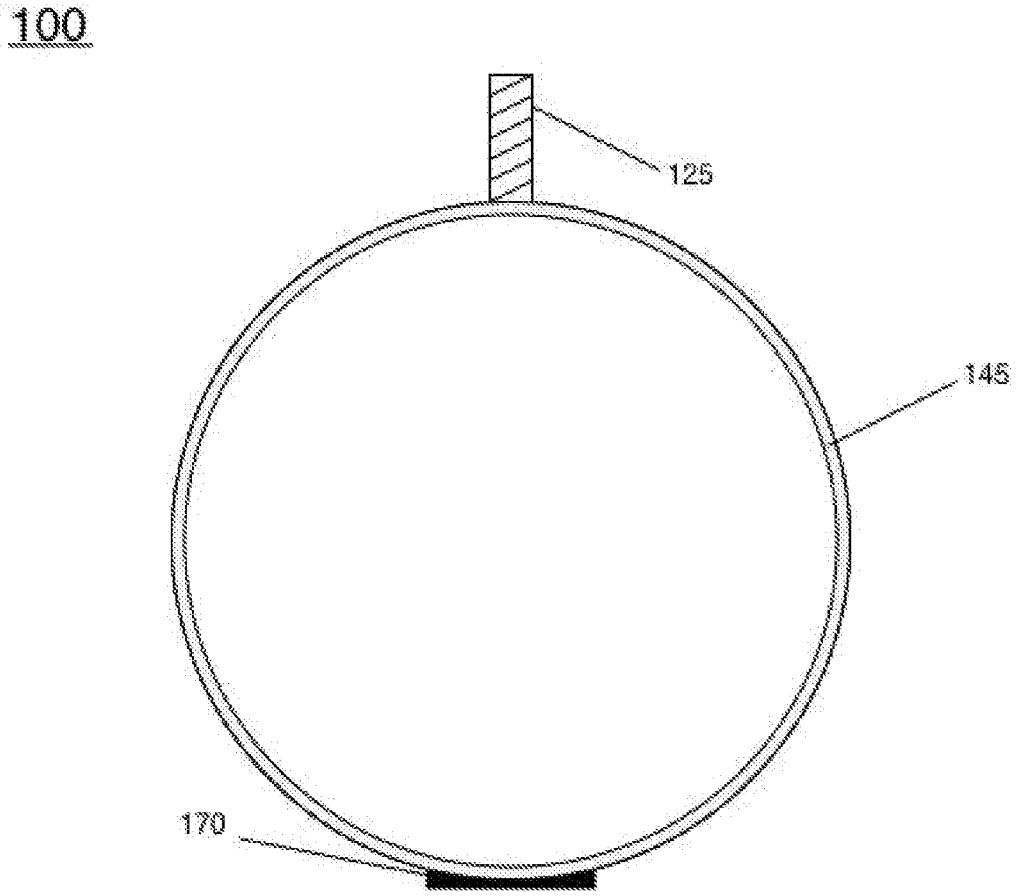
FIG. 2 is a front view of an embodiment of the present invention in an assembled form.
Figure 3:
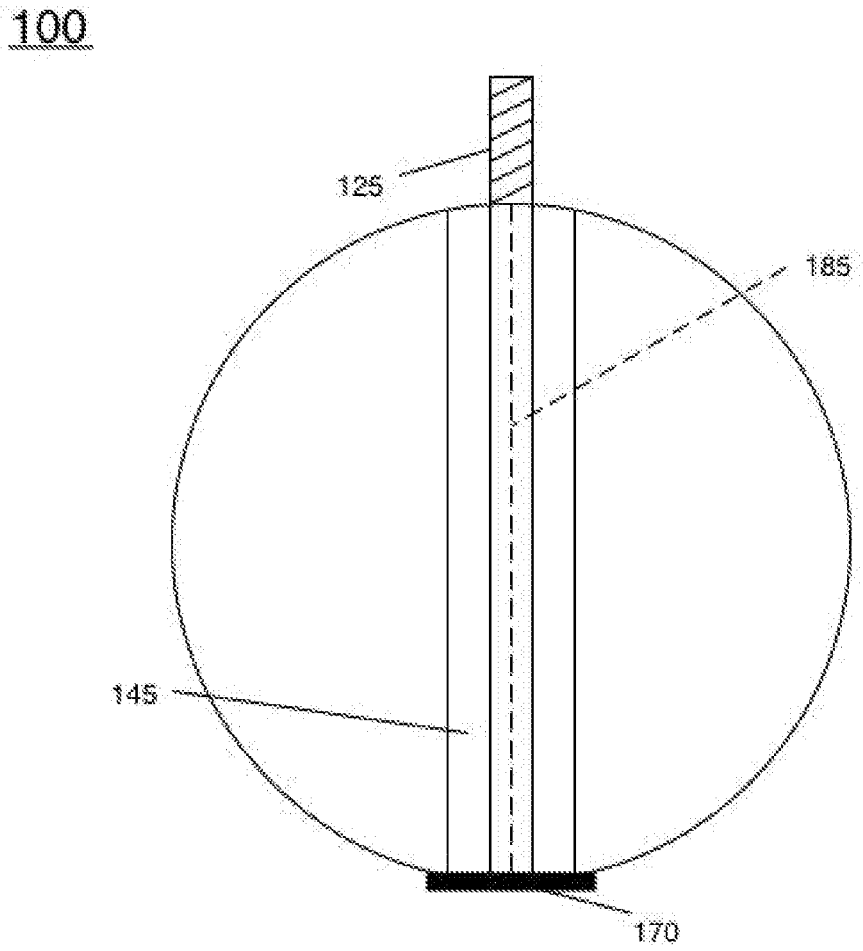
FIG. 3 is a side view of an embodiment of the present invention in an assembled form.
Figure 4:
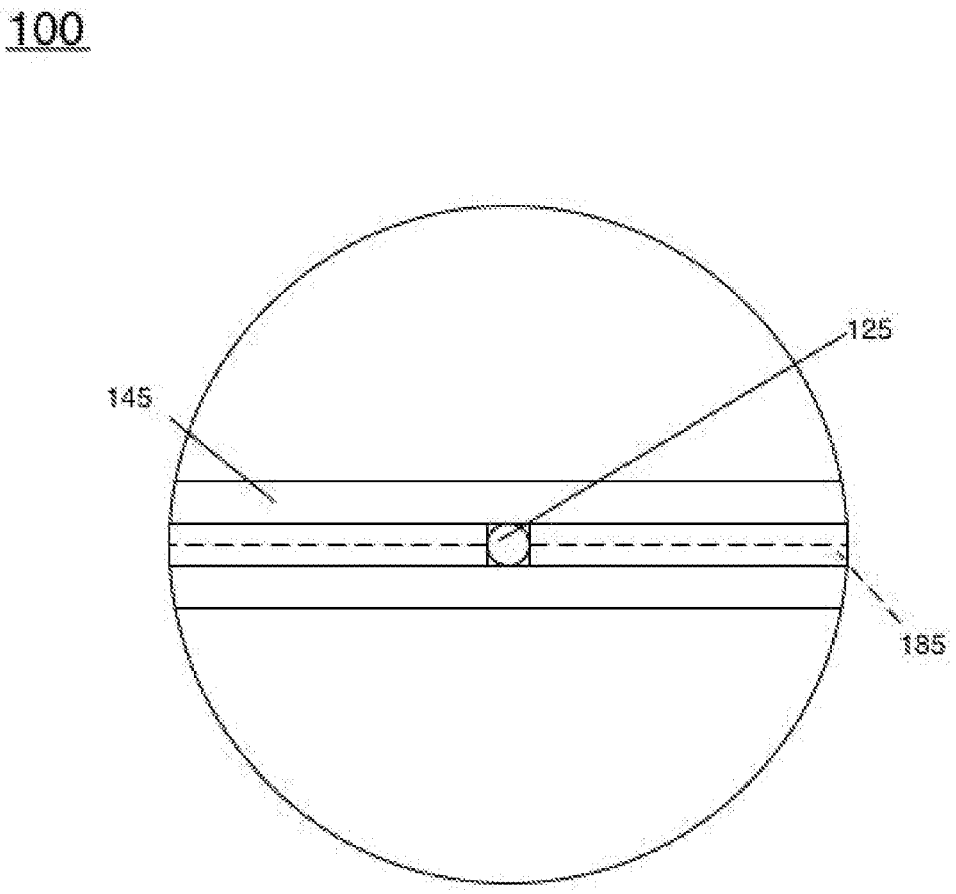
FIG. 4 is a top view of an embodiment of the present invention in an assembled form.
Figure 5:
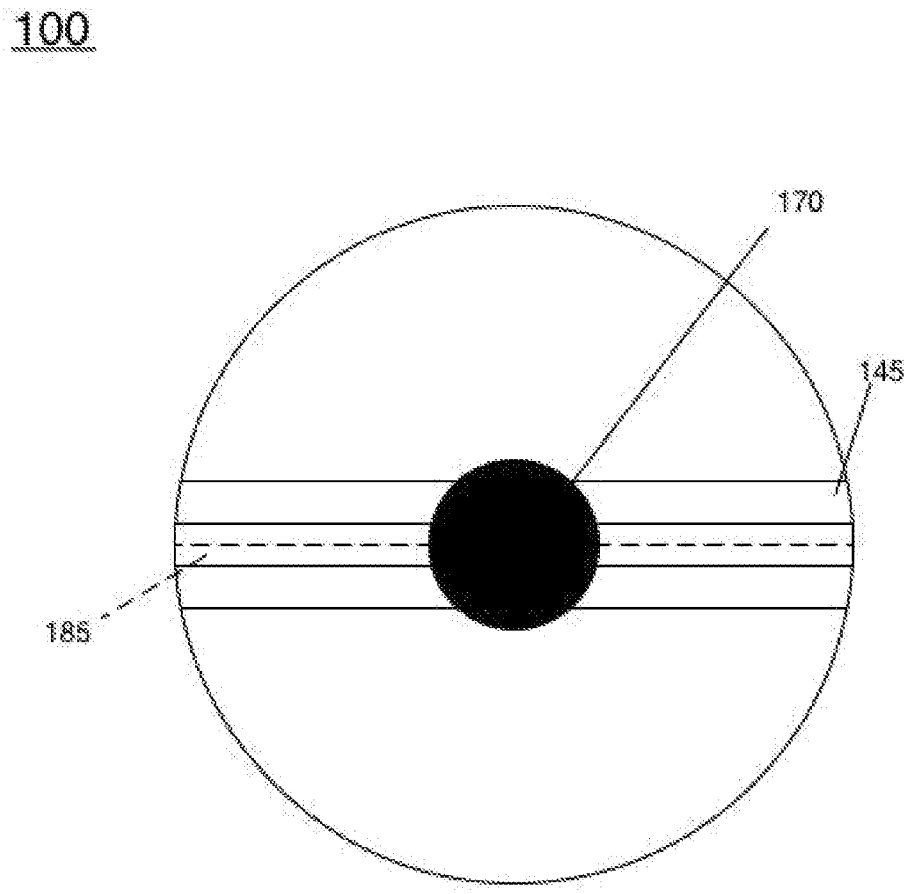
FIG. 5 is a bottom view of an embodiment of the present invention in an assembled form.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, there is a perspective view of an embodiment of a keepsake apparatus 100. The keepsake apparatus 100 may have a first section 105 and a second section 110 with each section having threading 120 thereon. In some embodiments, there may be more than two sections and may be as many as ten sections forming the keepsake apparatus 100. Each section may be sized to be the same or different as every other section. From one or both of the sections there may be a protruding member 125. A keepsake 130 may then be able to be stored therein.

The sections may be fashioned from any number of materials including plastics, glass, minerals, metals, ceramics, composites, resins, and the like or any combination thereof. Plastics used in construction of the sections may include polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof.

It is preferable that the material selected be chosen to enable the keepsake apparatus 100 to be translucent or transparent for viewing of the contents contained therein. In other embodiments, the material chose is opaque in nature thereby obscuring the contents held within the keepsake apparatus 100. Further, any such material(s) should be chosen to enable the object to have a sufficient rigidity and resiliency to prevent breaking of the keepsake apparatus 100 when dropped from a height of about ten feet.

The sections may be of varying shapes and sizes and may be polygonal or non-polygonal in shape. The sections are preferably shaped such that when the threads 120 are engaged to one another, an interior 115 or hollow is formed. In some embodiments, the keepsake apparatus 100 has an interior volume of about 1 $cm^3$ to about 10,000 $cm^3$ or other equivalent volumetric amounts. More preferably, the interior volume or hollow interior 115 is about 400 $cm^3$ to about 4,000 $cm^3$.

For example, the sections may be semi-circular, as shown, with each semi-circular section forming a concavity which forms the hollow interior 115 when the two sections are brought together. Further, the threads 120 may form a fluid seal when engaged thus enabling solids, liquids, and gases, and other matter states to readily be contained therein. In other embodiments, other mechanisms of sealing such as friction fits, putty, cements, glues, and the like or some combination thereof may be utilized. In some embodiments, an additional sealing member may be used such as an O-ring or the like to help create such a fluid seal. Preferably, the sections are transparent or translucent enabling one to visualize a keepsake 130 stored within.

The protruding member 125 is preferably a length of material that emanates from the keepsake apparatus 100 and may be utilized for securement of secondary items to the keepsake apparatus 100. The protruding member 125 may be formed from the same or a different material than the sections comprising the keepsake apparatus 100. In some embodiments, the protruding member 125 is removable. In other embodiments, the protruding member 125 may be integrated with the material forming the section or sections thereby permanently affixing it to the keepsake apparatus 100. The protruding member 125 may be coupled to either the first section 105 or the second section 110 or a combination thereof.

The protruding member 125 may be about 0.1" to about 6 inches in length and is more preferably about 0.15" to about 1" in length. The protruding member 125, in some embodiments, may be extendable and may be capable of being employed to couple the keepsake apparatus 100 to a secondary item (see FIGS. 6A and 6B). In such instances, the protruding member 125 may have threading thereon or may be sized to create a friction fit with the secondary item.

FIGS. 2-5 show an embodiment of the keepsake apparatus 100 from a front or back, side, top, and a bottom respectively. The structure of this particular embodiment of the keepsake apparatus 100 is apparent from these views. Shown in these figures are at least the protruding member 125, annular sealing member 145, planar surface 170, and juncture 185.

The annular sealing member 145 overlays the juncture 185 of the two sections thereby, in some embodiments, providing an enhanced or reinforced seal to prevent the contents of the keepsake apparatus 100 from leeching therefrom or the sections from separating from one another. In some embodiments the annular sealing member 145 may have an adhesive on one side which serves to adhere the annular sealing member 145 to the keepsake apparatus 100. In other embodiments, the annular sealing member 145 is sized to the particular keepsake apparatus 100 and retained by other mechanisms such as being coupled to the threading 120 (see FIG. 1) or other structure of the keepsake apparatus 100.

The planar surface 170 may be a surface of the keepsake apparatus 100 itself or may be a secondary piece affixed to a surface of the keepsake apparatus 100. If the planar surface 170 is affixed to the surface of the keepsake apparatus 100 then the planar surface 170 may be permanently affixed or removably affixed to the surface. If removably affixed to the surface, then the planar surface 170 may be repositionable on the surface of the apparatus 100 as needed. The planar surface 170 may be affixed via adhesives or other conventional means. The planar surface 170 may also comprise a non-slip or non-stick surface that allows the apparatus to be securely stored on a surface. In other embodiments, the planar surface 170 is simply a surface of the keepsake apparatus 100 that has been shaped, ground, etc. to provide a stable resting surface for the apparatus.

Figure 6A:
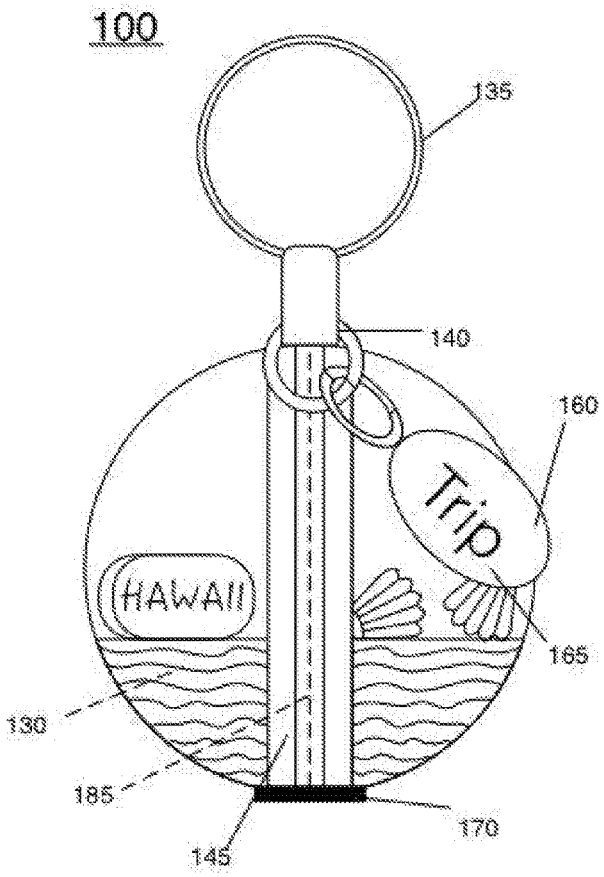
FIG. 6A is a side view of an embodiment of the present invention coupled to a key chain ring.
Figure 6B:
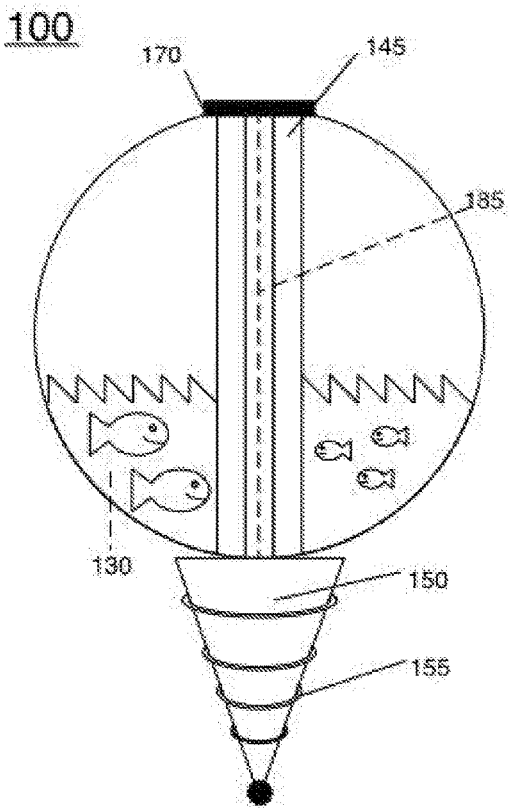
FIG. 6B is a perspective view of an embodiment of the present invention coupled to a bottle stopper.

FIGS. 6A and 6B illustrate various potential implementations of the keepsake apparatus 100. The implementations shown are for illustrative purposes only and other iterations may be contained under the purview of this application and apparent to those of ordinary skill in the art.

Referring to FIG. 6A, there is a keepsake apparatus 100 on a ring member 135 of a keychain. The keepsake apparatus 100 may have an annular sealing member 145 which covers the juncture 185 between the sections of the keepsake apparatus 100. The annular sealing member 145 may be a piece of fabric, such as a ribbon, or may be of a sturdier material such as a polymer band, a metal band, a composite band or the like or some combination thereof. A planar surface 170 allows the keepsake apparatus 100 to be positioned and remain level on a surface. The keepsake 130 is preferably visible through the keepsake apparatus 100.

The ring member 135 may be coupled to a threaded recess 140, via chain links or other connection means, which is capable of engaging the protruding member 125 (see FIG. 1) of the keepsake apparatus 100. In other embodiments, adhesives, snaps, clasps, buckles, friction fittings and the like may be used in lieu of threading. The ring member 135 enables the keepsake apparatus 100 to be easily transported and kept on a person or object under their control as desired. In some instances, the ring member 135 may be used to hang the keepsake apparatus 100 from another object such as a tree branch or limb or a specifically designed holding apparatus.

Further, a writable tag 160 having a writable surface 165 thereon may be coupled to the keepsake apparatus 100 or ring member 135. The writable tag 160 may comprise a particular material or have a particular coating that is conducive to receiving writing thereon. For example, the writable tag may be coated in a white paint or be comprised of a slate material.

In some embodiments, any such writing may be permanent whereas in other embodiments the writing may be removable. The writable tag 160 enables identification of the keepsake 130 contained therein via descriptions, dates, images, colors, symbols, etc. or any combination thereof. In some instances, the writable tag 160 features a particular image (embossed, engraved, etc.) on one side of the writable tag 160 and the writable surface 165 is on an opposing side of the writable tag 160. In other embodiments, both surfaces of the writable tag 160 may be configured to receive writing. The tag may be coupled to the apparatus 100 via conventional mechanisms such as fabrics, metals, chains, clasps, locks, and the like or some combination thereof.

Referring now to FIG. 6B, the keepsake apparatus 100 has been coupled to a bottle stopper 150. The bottle stopper 150 may have a threaded recess that receives and engages the protruding member 125 (see FIG. 1) of the keepsake apparatus.

As described herein, other mechanisms of coupling and attachment of the keepsake apparatus 100 and secondary object may be employed. The bottle stopper 150 may have stopper rings 155 disposed thereon to situate the bottle stopper 150 in an opening of a bottle thereby providing a substantially airtight seal. In other embodiments, such a structure may lack the stopper rings and function as a more decorative topper for a bottle or other receptacle as generally described herein. While the ring member 135, as shown in FIG. 6A, and the bottle stopper 150, as shown in FIG. 6B, may be used, the keepsake apparatus 100 may be coupled to virtually any other item. In other instances, the keepsake apparatus 100 is used on its own and is not coupled to any particular object.

Figure 7:
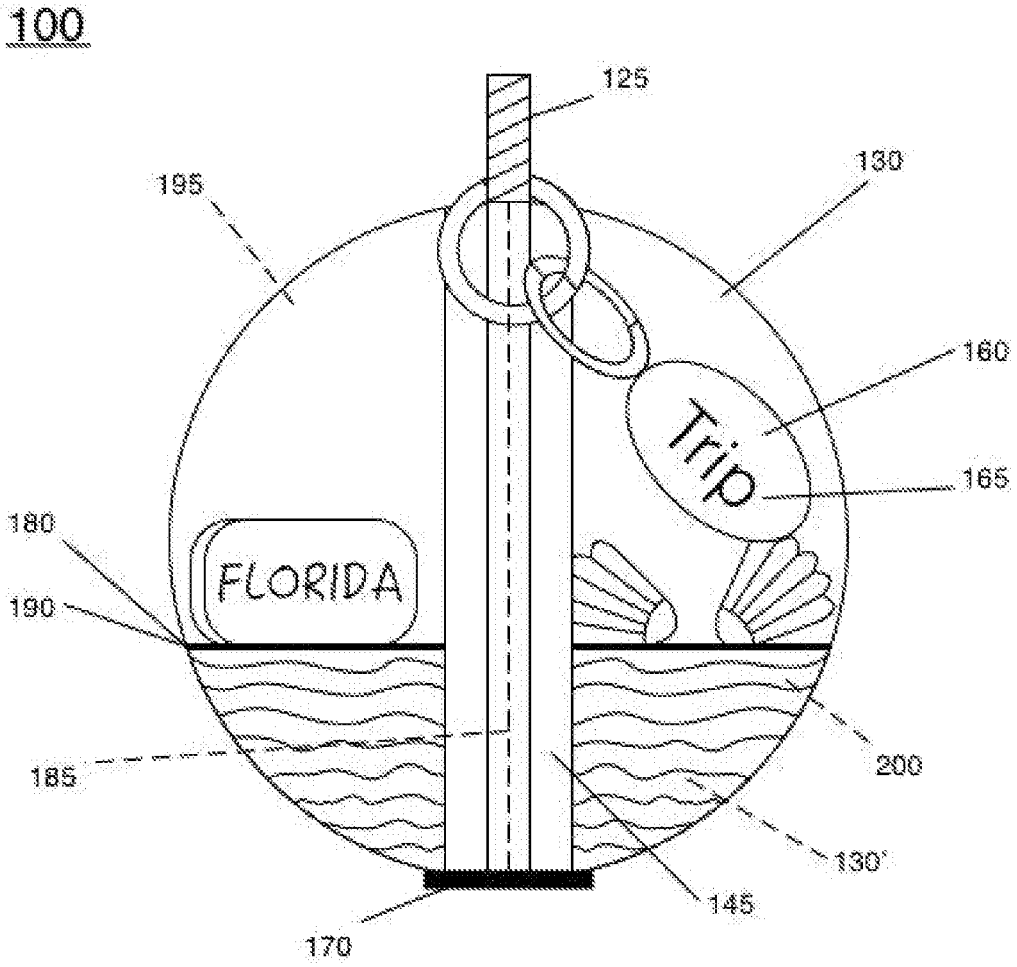
FIG. 7 is a front view of another embodiment of the present invention.

FIG. 7 demonstrates another embodiment of the present invention. Here the keepsake apparatus 100 may comprise a protruding member 125, a writable tag 160 having a writable surface 165, an annular sealing member 145, a planar surface 170, a dividing mechanism 180, coupling mechanisms 190, a first interior space 195, and a second interior space 200. A keepsake 130 and 130' may be reside in each of the first interior space 195 and the second interior space 200 respectively.

The dividing mechanism 180 divides the hollow interior into multiple sections. In some embodiments, there are multiple dividing mechanisms 180 utilized and such mechanisms may be oriented in any number of fashions within the keepsake apparatus 100. For example, the dividing mechanism 180 may form a number of parallel compartments or interior sections. In other embodiments, the dividing mechanism 180 may allow for both vertical and horizontal divisions. The dividing mechanism 180 may be held in place by a retainment mechanism 190 such as grooves in the inner surface of the sections. The retainment mechanism 190 may also be a repositionable or removable structure capable of being adhered to an inner surface of the keepsake apparatus 100. In some embodiments, the dividing mechanism 180 and retainment mechanism 190 interfaces with the threads on each of the two sections (see FIG. 1) in order to properly retain those elements. The dividing mechanism 180 is intended, in some embodiments, to form a fluid seal thereby allowing a liquid to be stored on one side of the dividing mechanism 180 and a solid to be stored on the other side of the dividing mechanism 180.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A keepsake apparatus comprising:

a retainment vessel comprising: a first section having first threads and a second section having second threads, the first section is threadably engaged to the second section, wherein the first threads and the second threads form a fluid seal;

a first planar dividing mechanism spanning a width of the retainment vessel;

a second planar dividing mechanism spanning a height of the retainment vessel, wherein the first planar dividing mechanism is perpendicular to the second planar dividing mechanism such that the first and the second planar dividing mechanism intersect at a junction point to divide an interior space of the retainment vessel into a plurality of sections; and a repositionable and removable retainment mechanism adhered to grooves of an inner surface of the retainment vessel to maintain a position of the first planar dividing mechanism and a position of the second planar dividing mechanism; and an extendable protruding member extending from the retainment vessel, wherein the extendable protruding member is coupled to a secondary object, and wherein the extendable protruding member is removable from the retainment vessel.

2. The apparatus of claim 1 wherein the retainment vessel is substantially circular in shape and has at least one planar surface thereon.

3. The apparatus of claim 2 wherein the at least one planar surface is on a bottom of the retainment vessel.

4. The apparatus of claim 1 further comprising a tag member configured to be coupled to the retainment vessel, the tag member having a writable surface thereon.

5. The apparatus of claim 1 wherein the secondary object is a bottle stopper or a keychain.

6. The apparatus of claim 5 wherein the bottle stopper or the key chain is threadably engaged to the extendable protruding member.

7. The apparatus of claim 1 wherein the retainment vessel is transparent.

8. The apparatus of claim 1 further comprising an annular sealing member disposed on an outer surface of the retainment vessel.

9. The apparatus of claim 8 wherein the annular sealing member is positioned and retained over a juncture of the first section and the second section.

10. The apparatus of claim 1 wherein the first section and the second section have a thickness defining the interior space of the retainment vessel when the first section is coupled to the second section.

11. A keepsake apparatus comprising:

a transparent retainment vessel comprising a first section having first threads and a second section having second threads, the first section being capable of being threadably engaged to the second section, wherein the first threads and the second threads form a fluid seal, and wherein the first section and the second section have a thickness defining an interior space of the retainment vessel when the first section is coupled to the second section;

a first planar dividing mechanism spanning a width of the transparent retainment vessel;

a second planar dividing mechanism spanning a height of the transparent retainment vessel, wherein the first planar dividing mechanism is perpendicular to the second planar dividing mechanism such that the first and the second planar dividing mechanism intersect at a junction point to divide the interior space of the transparent retainment vessel into a plurality of sections;

one or more removable or repositionable retainment mechanisms adhered to grooves of an inner surface of the transparent retainment vessel to maintain a position of the first planar dividing mechanism and a position of the second planar dividing mechanism;

an extendable threaded protruding member extending from a top end of the retainment vessel, wherein the extendable threaded protruding member is capable of being coupled to a threaded receptacle of a secondary object, and wherein the extendable threaded protruding member is removable from the retainment vessel;

at least one planar surface disposed on a bottom surface of the retainment vessel; and an annular sealing member disposed on an outer surface of the retainment vessel, the annular sealing member covering a juncture of the first section and the second section.

12. The apparatus of claim 11 wherein the annular sealing member is a metallic band.

13. A keepsake system comprising:

a transparent, circular retainment vessel comprising:

a first section having first threads; and a second section having second threads, the first section being capable of being threadably engaged to the second section at a juncture, wherein the first threads and the second threads form a fluid seal, wherein the first section and the second section have a thickness defining an interior space of the retainment vessel when the first section is coupled to the second section, and wherein a volume of the interior space of the retainment vessel is in a range between 400 $cm^3$ to 4000 $cm^3$;

a first planar dividing mechanism spanning a height of the retainment vessel and configured to divide the interior space of the retainment vessel into a first interior space and a second interior space;

a second planar dividing mechanism spanning a width of the retainment vessel and being located perpendicular to the first planar dividing mechanism, such that the first planar dividing mechanism and the second planar dividing mechanism intersect at a junction point to:

divide the first interior space into a first space and a third space; and divide the second interior space into a second space and a fourth space, wherein the first space and the second space are located above the second planar dividing mechanism, wherein the third space and the fourth space are located below the second planar dividing mechanism, wherein the first space and the second space share a first size and a first shape, wherein the third space and the fourth space share a second size and a second shape, wherein the first size is larger than the second size, and wherein the first shape differs from the second shape;

a first removable or repositionable retainment mechanism adhered to grooves of an inner surface of the transparent retainment vessel and configured to maintain a position of the first planar dividing mechanism;

a second removable or repositionable retainment mechanism adhered to grooves of the inner surface of the transparent retainment vessel and configured to maintain a position of the second planar dividing mechanism;

an annular sealing member disposed on an outer surface of the retainment vessel, wherein the annular sealing member is positioned and retained over the juncture;

an extendable threaded protruding member extending from an exterior of a top end of the retainment vessel at a location between the first space and the second space, wherein the extendable threaded protruding member is coupled to a threaded receptacle on a bottle stopper, wherein the bottle stopper comprises stopper rings disposed on an exterior of the bottle stopper such that the bottle stopper is retained by a beverage vessel, and wherein a length of the extendable threaded protruding member is between about 0.15" to 1";

a planar surface disposed on an exterior of a bottom surface of the retainment vessel at another location between the third space and the fourth space; and a tag member coupled to the extendable threaded protruding member of the retainment vessel, the tag member having a first side disposed opposite a second side, wherein the first side comprises a writable surface, wherein the writable surface comprises a slate material, and wherein the second side comprises an engraved or embossed image disposed thereon.

14. The system of claim 13, further comprising:

at least one first keepsake item retained by and visible through the first space;

at least one second keepsake item retained by and visible through the second space;

at least one third keepsake item retained by and visible through the third space; and at least one fourth keepsake item retained by and visible through the fourth space, wherein each of the at least one first keepsake item, the at least one second keepsake item, the at least one third keepsake item, and the at least one fourth keepsake item differs.

15. The system of claim 14, wherein the first side and/or the second side of the tag member identifies an identity or an origin of the at least one first keepsake item, the at least one second keepsake item, the at least one third keepsake item, and/or the at least one fourth keepsake item.

* * * * *